US011626219B2

(12) United States Patent
Ushiyama

(10) Patent No.: US 11,626,219 B2
(45) Date of Patent: Apr. 11, 2023

(54) CHIP RESISTOR AND METHOD FOR MANUFACTURING SAME

(71) Applicant: KOA CORPORATION, Ina (JP)

(72) Inventor: Kazuhisa Ushiyama, Ina (JP)

(73) Assignee: KOA Corporation, Nagano (JP)

( * ) Notice: Subject to any disclaimer, the term of this patent is extended or adjusted under 35 U.S.C. 154(b) by 0 days.

(21) Appl. No.: 17/584,788

(22) Filed: Jan. 26, 2022

(65) Prior Publication Data

US 2022/0230788 A1 Jul. 21, 2022

(30) Foreign Application Priority Data

Jan. 15, 2021 (JP) ..... JP2021-005107

(51) Int. Cl.
*H01C 1/14* (2006.01)
*H01C 17/00* (2006.01)
*H01C 7/00* (2006.01)

(52) U.S. Cl.
CPC ..... *H01C 1/14* (2013.01); *H01C 7/00* (2013.01); *H01C 17/006* (2013.01)

(58) Field of Classification Search
CPC ..... H01C 1/14; H01C 7/10; H01C 17/006; H01C 17/242
See application file for complete search history.

(56) References Cited

U.S. PATENT DOCUMENTS 6,150,920 A * 11/2000 Hashimoto ..... H01C 1/142 338/323
6,348,392 B1 * 2/2002 Nakayama ..... H01C 17/22 438/384
6,462,304 B2 * 10/2002 Kaida ..... H01C 17/242 338/195
7,394,344 B2 * 7/2008 Yoneda ..... H01C 7/003 338/307
7,782,174 B2 * 8/2010 Urano ..... H01C 1/142 338/307
7,940,158 B2 * 5/2011 Yoneda ..... H01C 17/006 338/307
9,905,340 B2 * 2/2018 Koda ..... H01C 17/281
10,224,132 B2 * 3/2019 Matsumoto ..... H01C 17/06
10,242,776 B2 * 3/2019 Morita ..... H01C 17/06
2018/0261361 A1 * 9/2018 Shinoura ..... H01C 17/006

FOREIGN PATENT DOCUMENTS

JP 2005-191406 A 7/2005
JP 5115968 B 1/2013

* cited by examiner

*Primary Examiner* — Kyung S Lee
(74) *Attorney, Agent, or Firm* — Carrier Shende & Associates, P.C.; Fulchand P. Shende; Joseph P. Carrier

(57) ABSTRACT

A glass protective film 4 is formed such that boundaries of top surface electrodes 3*a* and 3*b* do not exist at the base of corner portions of the rectangular glass protective film 4 so as to eliminate level differences generating due to thicknesses of the electrodes. Use of such a structure may resolve the problem that when printing glass paste individually over chip elements of a chip resistor on a large substrate from which multiple chips will be obtained, corner portions of the glass protective film bleed (flow) to the outer side (dividing grooves).

5 Claims, 8 Drawing Sheets

CHIP RESISTOR AND METHOD FOR MANUFACTURING SAME

TECHNICAL FIELD

The present invention relates to a chip resistor used for current detection etc., for example, and a manufacturing method thereof.

BACKGROUND ART

Many chip components such as chip resistors etc. are used in electronic apparatus etc., and miniaturization as well as high reliability of the components themselves are increasingly in demand. For example, a chip resistor having a low resistance value used for current detection etc. requires lower resistance for improvement in current detection precision, as well as a downsizing.

A typical chip resistor includes a resistive element formed on the top surface of an insulation substrate, and electrodes electrically connected to respective end parts of the resistive element, and is structured such that the surface of the resistive element and a part of the surfaces of the electrodes are covered by a glass protective film. The glass protective film is further covered by a resin protective film, and end electrodes and plating layers overlapping the end electrodes are formed on the surfaces of the electrodes and on the ends of the insulation substrate, etc.

The glass protective film is formed for protecting the resistive element from a laser used in a step of adjusting the resistance value of the chip resistor. In the case of manufacturing the chip resistor using a large substrate from which multiple chips will be obtained, for example, as disclosed in Patent Document 1, there is a method of forming a belt-like glass protective film so as to collectively cover multiple resistive elements on the large substrate.

However, when a glass protective film is formed collectively covering multiple resistive elements, a paste glass material printed as a glass protective film enters into slits (dividing grooves) provided for dividing the large substrate into individual pieces. Therefore, in a step of dividing the large substrate, the substrate may not crack along the dividing grooves, or otherwise a defective shape may generate in the cracked substrate.

In order to avoid such problems, a method of forming a glass protective film in island-shape so as to cover each of multiple resistive elements on a large substrate from which multiple chips will be obtained has also been conventionally used (e.g., Patent Document 2), instead of covering multiple resistive elements on a large substrate by using a glass protective film in a belt-like form.

PRIOR ART DOCUMENTS

Patent Documents

Patent Document 1: JP 2005-191406A
Patent Document 2: Patent Gazette No. 5115968A

DISCLOSURE OF THE INVENTION

Problems to be Solved by the Invention

As described above, since the glass protective films for individually covering multiple resistive elements on a large substrate from which multiple chips will be obtained are formed in rectangular shapes, such as glass protective films

94 illustrated in FIG. 12A, for example, a problem occurs that the corner portions of the rectangular glass protective films may bleed due to extrusion of a glass paste at the time of screen printing, and that the glass paste may flow into slits (dividing grooves) formed in the large substrate.

Such a problem becomes evident as the size of the chip resistor is miniaturized. That is, due to miniaturization of the chip resistor, the ratio of portions in which resistive elements and electrodes are formed in the total top surface of the insulation substrate increases, and the electrodes and the resistive elements are formed as far as positions near the slits (dividing grooves). As a result, the glass protective films covering the surfaces of the electrodes and the resistive elements are also consequently formed as far as positions near the slits (dividing grooves).

At this time, when borders (borders between portions in which electrodes are formed and portions in which electrodes are not formed) of electrodes 93*a* and 93*b* exist at the base of corner portions G1 to G4 of the rectangular glass protective films 94 as illustrated in FIG. 12A, slight level differences generate due to thicknesses of the electrodes. These level differences affect printing of the glass paste, generating a problem that the corner portions G1 to G4 of the glass protective films 94 bleed as far as slits (dividing grooves) 1*a*, which are either longitudinal end part of the respective insulation substrates or individual chip regions, as indicated by white arrows in FIG. 12B.

This kind of bleeding at the corner portions of the glass protective films may have a problem that crack defects generate when dividing the large substrate into individual pieces, and may damage glass in a plating step due to the glass of the protective film being exposed from longitudinal side surfaces of the insulation substrates, affecting reduction in acid tolerance. Furthermore, there is a problem that the glass bleeding from the rectangular corner portions is exposed, interspersed along the longitudinal direction of the insulation substrate, adversely affecting the shape of the chip resistor or the like.

On the other hand, in the case of the chip resistor having a low resistance value used for current detection described above, reducing the areas (formation regions) of the resistive elements by reducing the distance between the electrodes formed on the insulation substrate so as to further lower resistance, for example, may be considered. However, since the chip resistor has standardized outer dimensions, if the areas of the resistive elements become small, areas of the electrodes on the insulation substrate increase accordingly.

Typically, the electrodes of the chip resistor are formed in rectangular shapes on the top surfaces of the insulation substrates. However, if rectangular electrodes are formed in wide areas (formation regions) by making the areas of the resistive elements smaller as described above, a large amount of electrode material is required. In this case, a problem that the cost of the chip resistor increases due to influence of Ag and Pd included in the electrode material occurs.

In light of these problems, the present invention aims to prevent glass protective films from flowing into slits (dividing grooves) in a step of forming elements for multiple chip resistors on a large substrate from which multiple chips will be obtained.

Means of Solving the Problems

As a means of achieving the aim and solving the above problems, the following structure is provided, for example. That is, a chip resistor of the present invention is characterized by including: a rectangular parallelepiped insulation substrate; paired top surface electrodes arranged facing each other at predetermined intervals at either longitudinal end part on the top surface of the insulation substrate; a resistive element formed between the paired top surface electrodes; and a rectangular protective film covering a predetermined region of the insulation substrate. The predetermined region is a region including the entire top surface of the resistive element and connection regions of the resistive element and the paired top surface electrodes, and the protective film is formed so as for four corner portions of the protective film in plan view to not overlap the paired top surface electrodes, and so as to avoid either longitudinal end part on the top surface of the insulation substrate.

For example, it is characterized in that the paired top surface electrodes each comprise an extension part having a wider width than that of the resistive element in the lateral direction of the insulation substrate at the connection regions, and other regions excluding the extension parts have approximately the same width as that of the resistive element. For example, it is characterized in that the width of the extension parts gradually changes so as to approach the width of the resistive element the further toward either longitudinal end part of the insulation substrate. Further for example, it is characterized in that the protective film is a glass protective film.

Moreover, a chip resistor manufacturing method according to the present invention is characterized by including the steps of forming latticed primary dividing grooves and secondary dividing grooves orthogonal to each other on the top surface of a large insulation substrate from which multiple chip resistors are obtained; forming multiple electrodes facing each other at predetermined intervals in multiple predetermined regions divided by the primary and the secondary dividing grooves on the top surface of the large insulation substrate; forming multiple resistive elements respectively stretching over the multiple electrodes arranged facing each other; forming a rectangular glass protective film for individually covering regions including the entire top surfaces of the respective multiple resistive elements and connection regions of the multiple resistive elements with the respective multiple electrodes; forming a trimming groove in the respective multiple resistive elements after the glass protective film is formed, so as to adjust resistance values; dividing the large insulation substrate along the primary dividing grooves so as to obtain strip substrates; forming end electrodes on side surfaces of the strip substrates; and dividing the strip substrates, on which the end electrodes are formed, along the secondary dividing grooves so as to obtain chip resistive elements. The glass protective film is formed so as for four corner portions of the glass protective film in plan view to not overlap the respective multiple electrodes, and so as to avoid the secondary dividing grooves.

For example, it is characterized in that the multiple electrodes each comprise an extension part having a wider width than that of each of the multiple resistive elements in the direction of the primary dividing grooves at each of the connection regions, and other regions excluding the extension parts have approximately the same width as that of each of the multiple resistive elements. Further for example, it is characterized by further including the step of forming multiple resin protective films extending in a belt-like form along the primary dividing grooves.

Results of the Invention

According to the present invention, a chip resistor resolving the problem that the corner portions of the rectangular glass protective films formed on the top surfaces of the resistive elements etc. bleed to the outer side (dividing grooves), and a manufacturing method thereof may be provided.

BRIEF DESCRIPTIONS OF DRAWINGS

DESCRIPTION OF EMBODIMENT

Figure 1:
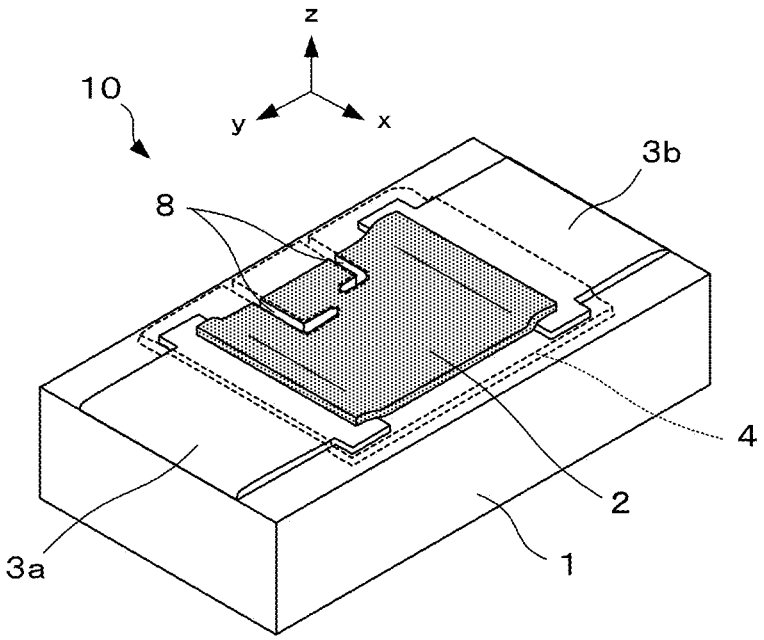
FIG. 1 shows an external perspective view of a chip resistor according to an embodiment of the present invention.
Figure 2:
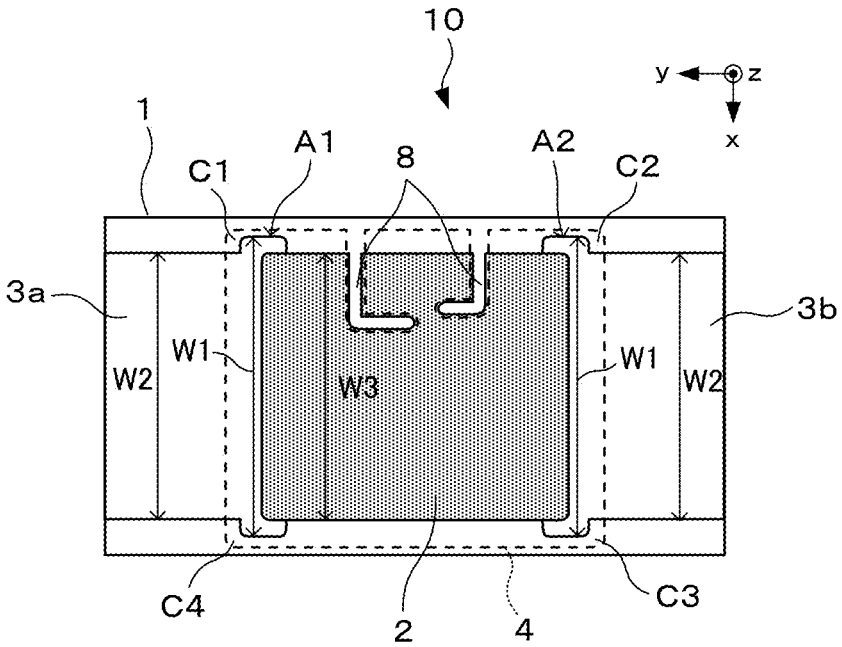
FIG. 2 is a plan view of the chip resistor illustrated in FIG. 1 when viewed in a z-direction.

A preferred embodiment of the present invention is described below in detail referencing the attached drawings. FIG. 1 shows an external perspective view of a chip resistor according to the embodiment, and FIG. 2 is a plan view of the chip resistor illustrated in FIG. 1 when viewed in a z-direction.

An insulation substrate 1 of a chip resistor 10 illustrated in FIG. 1 etc. is an electrically insulative substrate made of alumina ($Al_2O_3$) etc. having a predetermined thickness and shape (rectangular parallelepiped shape), and is one of multiple substrates obtained by dividing a large substrate described later along horizontal and vertical dividing grooves (slits).

A resistive element 2 is formed on the top surface (surface) of the insulation substrate 1. The resistive element 2 is a thick-film resistive element resulting from screen printing into a rectangular shape a resistive paste made of a resistor material such as ruthenium oxide ($RuO_2$), copper (Cu), silver-palladium (Ag—Pd), etc., for example, on the surface of the insulation substrate 1, and then baking and forming. Slits (trimming grooves) 8 for adjusting resistance value are formed in the resistive element 2.

The size of the chip resistor 10 has dimensions corresponding to the standard, 1.6 mm×0.8 mm, for example. In the case of using the chip resistor 10 having lower resistance in an application such as electric current detection etc., a resistor material having low electrical resistance is preferred. However, a thin-film resistive element such as a metal film may be used as the resistive element 2, according to desired properties.

Note that the chip resistor with low resistance is used in protection circuits for batteries, electric current detecting circuits, etc., for example, where its resistance value is 100 Ω or less, for example.

Paired top surface electrodes (upper electrodes) 3*a* and 3*b* electrically connected to the resistive element 2 are formed on either longitudinal (y-direction) end part on the top surface of the insulation substrate 1. Furthermore, back electrodes (bottom electrodes) omitted from the drawing are formed at bottom ends of the insulation substrate 1, sandwiching the insulation substrate 1 at positions corresponding to the top surface electrodes.

While omitted from the drawing, end electrodes electrically connecting between the top surface electrodes and the back electrodes are formed on either longitudinal end side surface of the insulation substrate 1. Furthermore, external electrodes (metal plating) omitted from the drawing are formed on the chip resistor 10 so as to cover the respective back electrodes, the respective end electrodes, and a part of a resin protective film (omitted from the drawing).

The entire surface of the resistive element 2 and at least a part of the surfaces of the top surface electrodes 3*a* and 3*b* are covered by a glass protective film 4, which is made by screen printing a borosilicate glass paste, for example. While omitted from the drawing, the resin protective film functioning as an insulative film on the outermost layer is formed on the glass protective film 4.

The glass protective film 4 as described later is a protective film formed in island-shape so as to cover each of multiple resistive elements etc. on a large substrate from which multiple chips will be obtained. Note that the glass protective film 4 is indicated by a dotted line in FIG. 1 etc. since it is made of either transparent or semi-transparent glass.

As illustrated in FIG. 2, according to the chip resistor 10 of the embodiment, the top surface electrodes 3*a* and 3*b* are formed such that width W1 (in an x-direction) of connection regions (portions overlapping the resistive element 2, also referred to as extension parts A1 and A2) with the resistive element 2 is wider than width W2 of other regions than those connection regions and connecting to the extension parts A1 and A2, and the width W2 of the portions other than the extension parts A1 and A2 is approximately the same width as width W3 of the resistive element 2.

A reason why the extension parts A1 and A2 formed wider than the resistive element 2 include the top surface electrodes 3*a* and 3*b* is to allow divergence from the desired printing position of the resistive element 2 having approximately the same width as that of the top surface electrodes 3*a* and 3*b*. Furthermore, having the extension parts A1 and A2 may prevent corner portions (four corner portions) C1 to C4 of the glass protective film 4 from overlapping the boundaries of the top surface electrodes 3*a* and 3*b* on the insulation substrate.

Meanwhile, formation such that the width of the resistive element 2 and width of the top surface electrodes 3*a* and 3*b* except for the respective extension parts A1 and A2 are approximately the same secures current routes and makes current density constant, thereby allowing suppression of heat generation due to concentration of current at a specific place. Furthermore, sufficient areas for attaching probes for resistance value measurement may be secured in the top surface electrodes 3*a* and 3*b* except for the wide portions (extension parts A1 and A2).

Moreover, making the width of the resistive element 2 and those of the top surface electrodes 3*a* and 3*b* approximately the same prevents easy occurrence of divergence from the desired current routes from the top surface electrodes to the resistive elements, thereby contributing to miniaturization of the resistive elements, namely reduction in resistance of the chip resistors.

The glass protective film 4 has an approximately rectangular shape as illustrated in FIG. 2, and as described above, is arranged such that boundaries of the top surface electrodes 3*a* and 3*b* do not exist at the base of the corner portions C1 to C4. In other words, the glass protective film 4 is formed at positions where the corner portions C1 to C4 are not overlapping the top surface electrodes 3*a* and 3*b* in plan view (when viewed in a z-direction).

Use of such an arrangement eliminates generation of level differences in the corner portions C1 to C4 of the glass protective film 4 due to thicknesses of the top surface electrodes 3*a* and 3*b*, and thereby preventing bleeding of a glass paste to be printed. While the level differences are approximately several μm to several tens of μm when compared to the insulation substrate top surface, it is a notable level difference in a small chip resistor.

Furthermore, such an arrangement of the glass protective film 4 as described above prevents the glass protective film from flowing into dividing grooves formed in a large substrate described later from which multiple chips will be obtained, and thus defective division etc. does not occur easily.

Moreover, freedom of design is improved due to prevention of flowing of the glass protective film. For example, the width of the top surface electrodes 3*a* and 3*b* and that of the resistive element 2 may be set more widely, and either the top surface electrodes may be formed relatively thicker (e.g., 10 μm or greater), or two or more layers may be stacked and formed. As a result, the chip resistor with higher power (shunt resistor used for large-current detection, etc.) may be implemented by increasing its own volume.

In addition, as illustrated in FIG. 1 and FIG. 2, completely covering the extension parts A1 and A2 of the top surface electrodes 3*a* and 3*b* by the glass protective film 4 allows securing of electrical insulation of electrodes in adjacent regions divided by the dividing grooves and prevention of current leakage in manufacturing steps, thereby improving measuring precision when adjusting resistance value. As a result, difference in resistance value allowance may be reduced so as to obtain a low-resistance chip resistor having highly accurate low resistance, for example.

Figure 3:
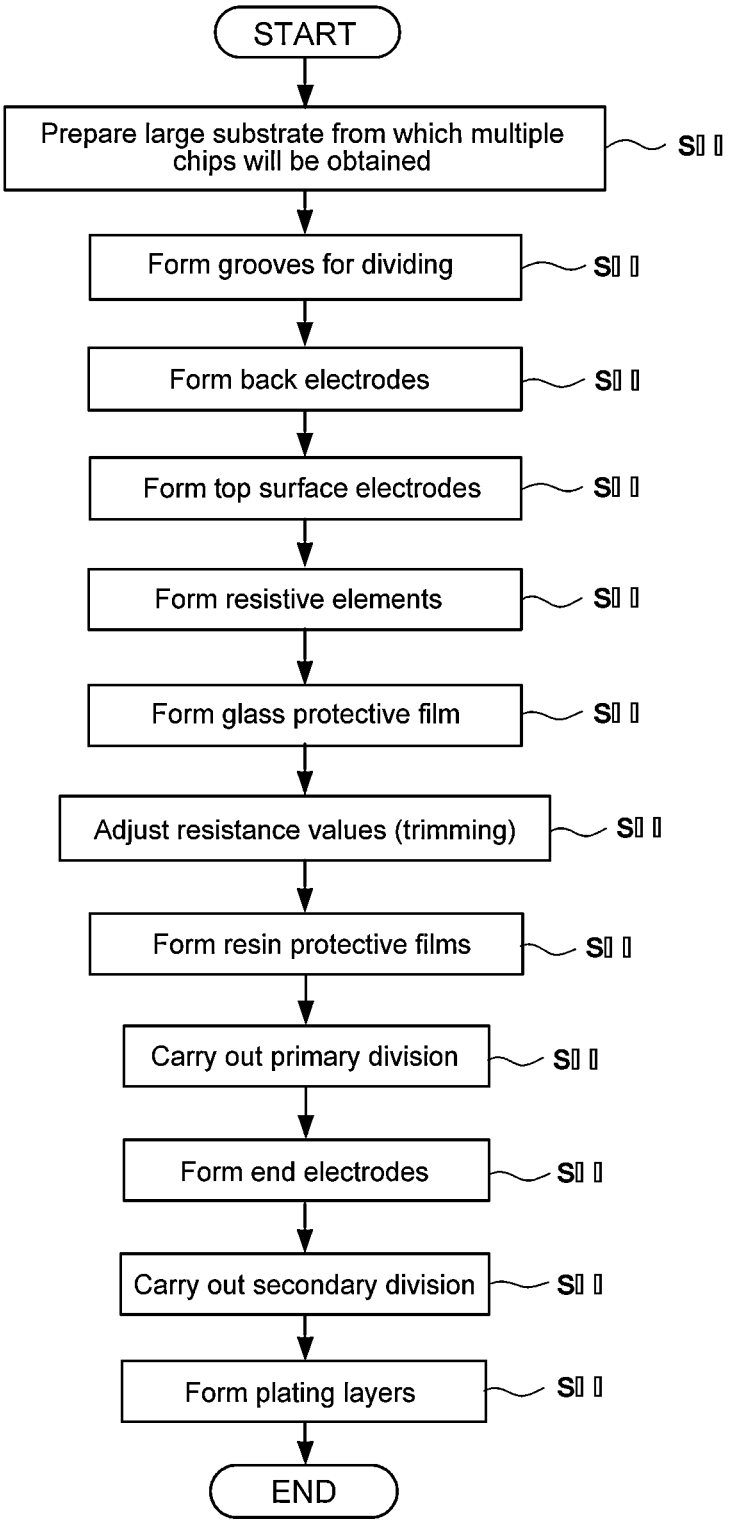
FIG. 3 is a flowchart of chip resistor manufacturing steps according to the embodiment given in time series.

Next, a chip resistor manufacturing method according to the embodiment is described. FIG. 3 is a flowchart of chip resistor manufacturing steps according to the embodiment given in time series.

First, an insulation substrate is prepared in step S11 of FIG. 3. Here, a large substrate, such as an alumina ($Al_2O_3$) substrate or a ceramic substrate, from which multiple chips will be obtained, is prepared. In the subsequent step S13, as grooves (slits) for dividing the insulation substrate, primary dividing grooves are formed in the top surface in one direction of the substrate, and secondary dividing grooves are formed in the top surface in a direction orthogonal to the one direction. Note that these dividing grooves may be formed not only in the top surface of the insulation substrate, but also in the back surface.

Figure 4:
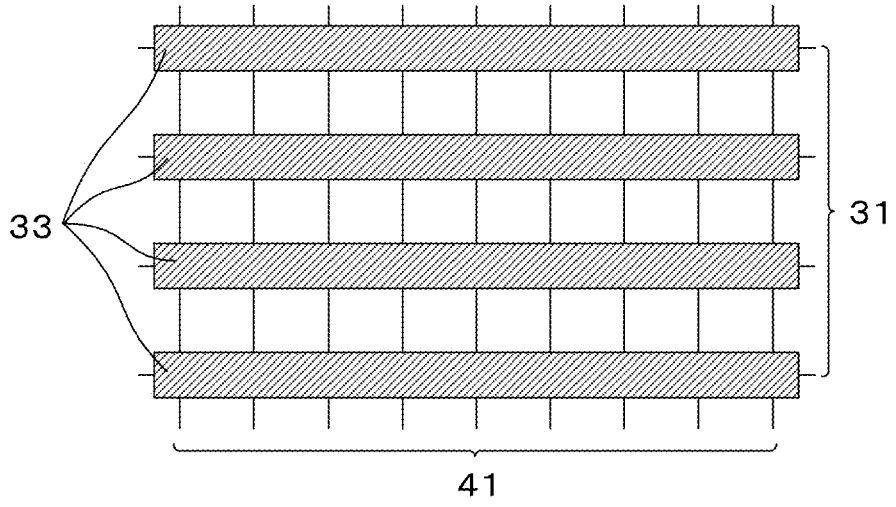
FIG. 4 is a diagram illustrating back electrodes formed on a large insulation substrate.

In step S15, back electrodes are formed in the respective regions divided by the dividing grooves described above. For example, silver (Ag) paste electrode materials (back electrodes) 33 are screen printed, as partially illustrated in FIG. 4. The electrode materials 33 extend along primary dividing grooves 31 while stretching over the primary dividing grooves 31 in the back surface of the insulation substrate, and have a predetermined width in the extending direction of secondary dividing grooves 41. The back electrodes may be formed either by screen printing the electrode materials 33 in a belt-like form, or by individually screen printing in island-shape the respective regions divided by the dividing grooves, as illustrated in FIG. 4. The electrode materials 33 after screen printing are dried and then baked at 850° C., for example.

Figure 5:
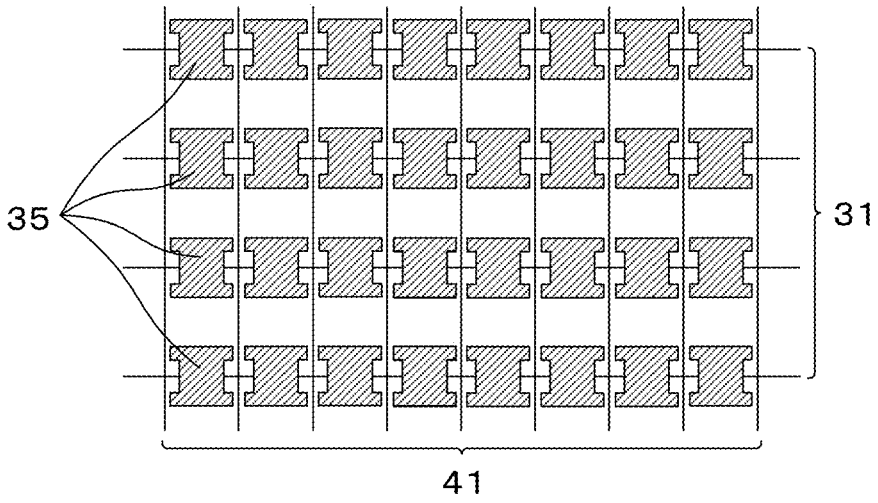
FIG. 5 is a diagram illustrating top surface electrodes formed on the large insulation substrate.

In step S17, top surface electrodes are formed. For example, as illustrated in FIG. 5, silver (Ag) paste electrode materials (top surface electrodes) 35 are screen printed in the upper surface (top surface) of the insulation substrate at positions where those materials stretch over respective primary dividing grooves 31 and are each sandwiched by two adjacent secondary dividing grooves 41, so as to face each other at predetermined intervals along the secondary dividing grooves 41. The electrode materials 35 are dried and then baked at 850° C., for example.

In the respective individual insulation substrates formed by dividing a large insulation substrate, the printed electrode materials (top surface electrodes) 35 respectively have a shape where the central part sides have wide extension parts, and the end part sides are narrower than the extension parts and have the same width as resistive elements to be printed in the next step.

The electrodes of individual chip resistors formed in steps S15 and S17 described above respectively configure paired back electrodes on the bottom surface of the insulation substrate, and paired top surface electrodes on the top surface of the insulation substrate.

Note that the back electrodes and the top surface electrodes may either be formed from the same electrode material as described above, or may use different electrode materials. Furthermore, formation order of the back electrodes and the top surface electrodes is not limited to that described above, and the back electrodes may be formed after the top surface electrodes are formed. Alternatively, the back electrodes and the top surface electrodes may be formed in the same step.

Figure 6:
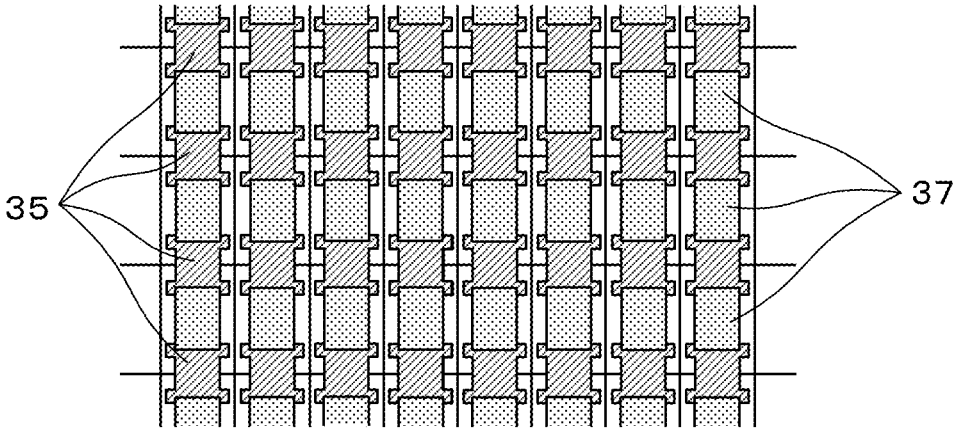
FIG. 6 is a diagram illustrating resistive elements formed between the top surface electrodes on the large insulation substrate.

In step S19, resistive elements are formed between the top surface electrodes. Here, as illustrated in FIG. 6, resistive elements 37 are each formed between paired opposing top surface electrodes 35 in each of the divided regions (individual regions surrounded by the primary dividing grooves and the secondary dividing grooves) of the top surface of the insulation substrate, and a part of each resistive element 37 overlaps the top surface electrodes 35 and is electrically connected thereto. The resistive elements 37 are formed by screen printing a resistive paste made of ruthenium oxide ($RuO_2$) etc., for example, drying and then baking at 850° C., for example.

Note that while the resistive elements 37 are formed with a part thereof overlapping the top surface electrodes 35, the vertical (z-direction) positional relationship between the overlapped portions is arbitrary. That is, either the end parts of the resistive element 2 may be positioned on the upper parts of the top surface electrodes 3*a* and 3*b* as illustrated in FIG. 1 etc., or the end parts of the top surface electrodes may be positioned on either end upper part of the resistive element once the resistive element is formed on the insulation substrate.

Figure 7:
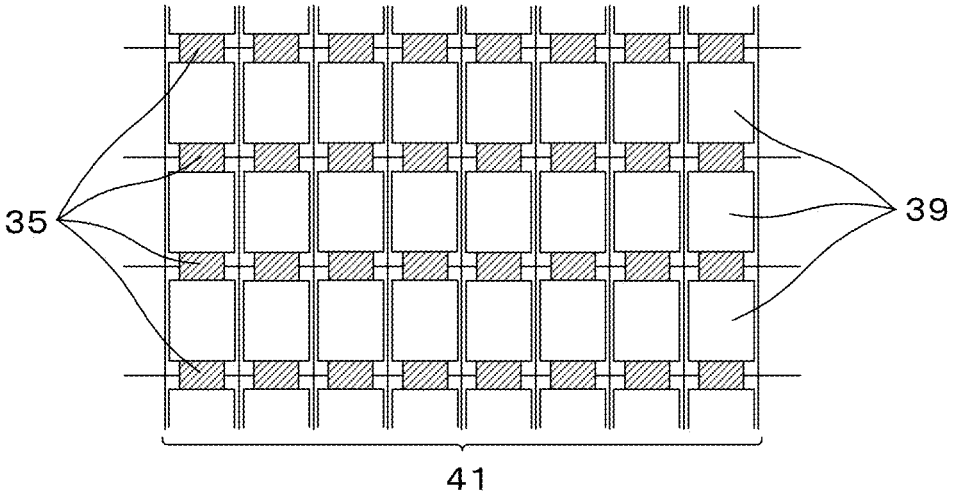
FIG. 7 is a diagram illustrating glass protective films formed so as to cover the entire surfaces of the resistive elements and a part of the top surface electrodes on the large insulation substrate.

In step S21, as illustrated in FIG. 7, for example, approximately rectangular glass protective films 39, which cover the entire top surfaces of the resistive elements 37 formed in step S19 described above, the entire extension parts (see FIG. 5) of the top surface electrodes 35, and a part of other portions, are formed individually.

At this time, the glass protective films 39 are formed at positions where the corner portions (four corner portions) of the glass protective films 39 when viewed from above do not overlap the top surface electrodes 35, that is, at either edge parts of the divided regions of the insulation substrate top surface, namely at positions where the secondary dividing grooves 41 are avoided, as illustrated in FIG. 7.

The glass protective films 39 are formed for the purpose of protecting the resistive elements 37 from a laser used in the step of adjusting resistance value of the chip resistor described later, and improving trimming precision etc.

The glass protective films 39 are formed by, for example, screen printing a protective film paste made of borosilicate glass at the positions described above, drying, and then baking. The protective film paste is baked at 600° C., for example, so as to form the glass protective films.

Figure 8:
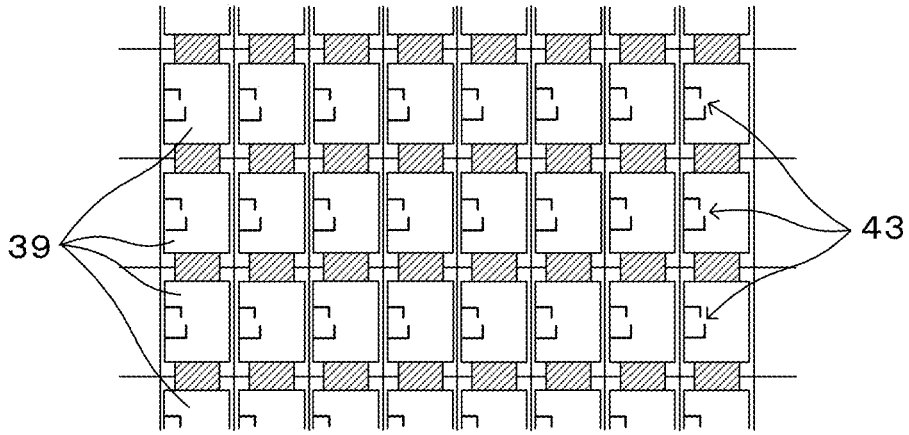
FIG. 8 is a diagram illustrating slits (trimming grooves) for resistance value adjustment of the resistive elements on the large insulation substrate.

In step S23, as illustrated in FIG. 8, for example, slits (trimming grooves) 43 are made in the resistive elements using a laser beam from above the glass protective films 39 formed in step S21 described above so as to adjust (trim) resistance values of the resistive elements.

The resistance values of the resistive elements may be adjusted to a desired value by adjusting the distance (width) between the electrodes and/or thickness of the resistive elements, or otherwise using a method of forming the trimming grooves in a part of the resistive elements etc. Here, adjustment is carried out so as to reach a target resistance value by making slits in the resistive elements using a laser beam based on the resistance values between the top surface electrodes. The number and shape of the trimming grooves are changed in accordance with the target resistance value.

Note that once the trimming step S23 is carried out after the glass protective film forming step S21 as described above, the glass protective films will function as protective films for the resistive elements, and generation of microcracks in the resistive elements due to laser irradiation in the trimming step will be reduced.

Moreover, when performing the trimming step S23, the entire expansion parts of the top surface electrodes are already covered by the glass protective films in the glass protective film forming step S21, therefore insulation between adjacent top surface electrodes can be heightened via the slits (dividing grooves). This allows suppression of leakage of to-be-measured current to the adjacent top surface electrodes, and measurement and adjustment of resistance values with precision at the time of adjusting the resistance values through laser trimming.

Figure 9:
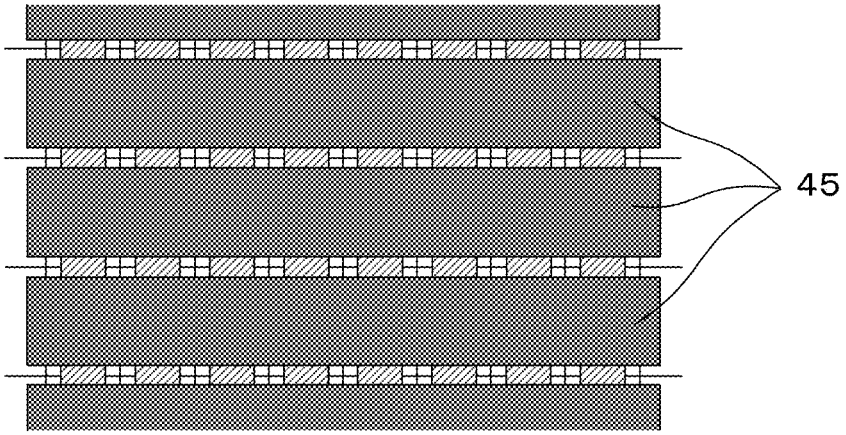
FIG. 9 is a diagram illustrating resin protective films formed so as to cover the glass protective films etc. on the large insulation substrate.

In step S25, resin protective films are formed. Here, belt-like resin paste, which continues along the primary dividing grooves so as to cover the entire top surfaces of the glass protective films 39 and the entire or a part of the top surface electrodes 35, is screen printed as illustrated in FIG. 9. Once dried, it is then heat cured at 200° C., for example, forming resin protective films 45.

The resin protective films 45 are made of a heat curing type resin paste, which results from adding a filler to epoxy resin that is a heat curing type resin.

Accordingly, since the resin protective films have flexibility, even if printing on the slits (dividing grooves) of the substrate, division of the substrate carried out later is not hindered.

In step S27, the large insulation substrate is divided (primary division) into strips along the primary dividing grooves 31 provided in the substrate in step S13. In the subsequent step S29, the substrates obtainded by dividing the insulation substrate into strips in step S27 described above are stacked, and a NiCr alloy material, for example, is deposited through sputtering on one of broken surfaces (either side surface parts), forming end electrodes.

Note that instead of the sputtering described above, resin silver (Ag) paste may be applied, dried and baked so as to form the end electrodes, for example.

In step S31, the substrate divided into strips and on which the end electrodes are formed as described above is further divided into chips along the secondary division grooves 41 provided in the large insulation substrate in step S13. As a result, chip elements (fragments) having the same size as the chip resistor 10 illustrated in FIG. 1 etc. are obtained.

In step S33, plating layers (external electrodes) are formed using nickel (Ni), tin (Sn), gold (Au), copper (Cu) etc., for example, so as to cover the entirety of the end electrodes and the back electrodes, and a part of the top surface electrodes and the resin protective films.

The plating layers may be made into a laminated structure through solder plating etc. after base plating using nickel etc. is applied. Note that once the substrate is divided into strips, the plating layers may be formed before dividing them into fragments.

<Modified Examples>

Figure 10:
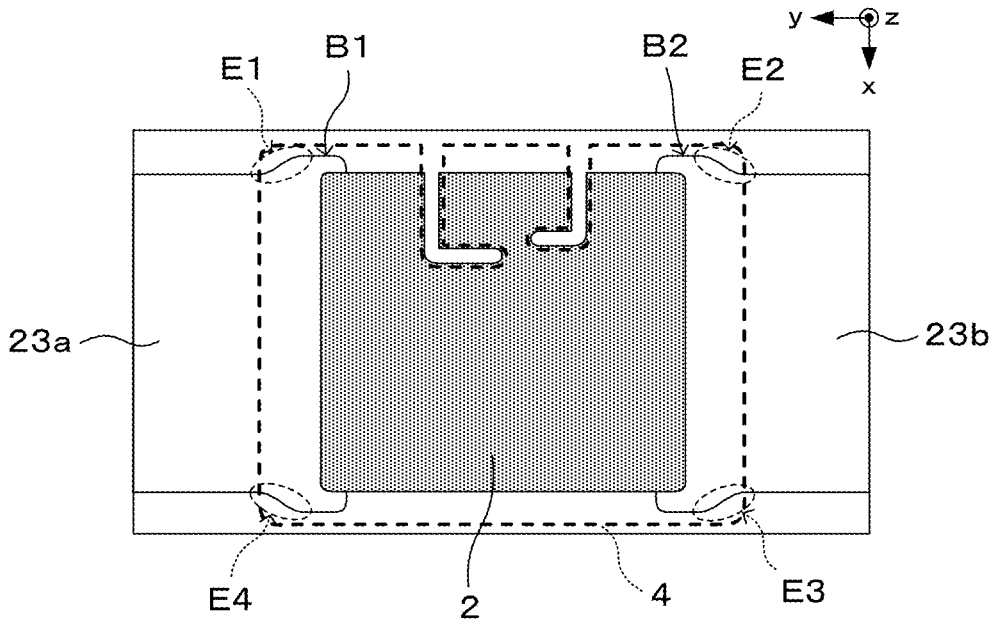
FIG. 10 is a diagram illustrating a modified example of the shape of extension parts of the top surface electrodes.

The chip resistor according to the embodiment is not limited to the structure described above, and various modifications are possible. For example, the form of the extension parts (portions overlapping the resistive elements) of the top surface electrodes is not limited to the examples illustrated in FIG. 1 etc. For example, either side end parts of respective extension parts B1 and B2 of top surface electrodes 23*a* and 23*b* may be formed in a form gradually and gently changing such that the further toward the end sides of the top surface of the insulation substrate 1 in either longitudinal direction (y-direction), the closer the width thereof approaches the width of the resistive element 2, as shown enclosed by broken line circles E1 to E4 in FIG. 10.

This eliminates divergence of the current routes between the top surface electrodes 23*a* and 23*b* and the resistive element 2, thereby allowing suppression of heat generation due to concentration of current during electric conduction.

Figure 11:
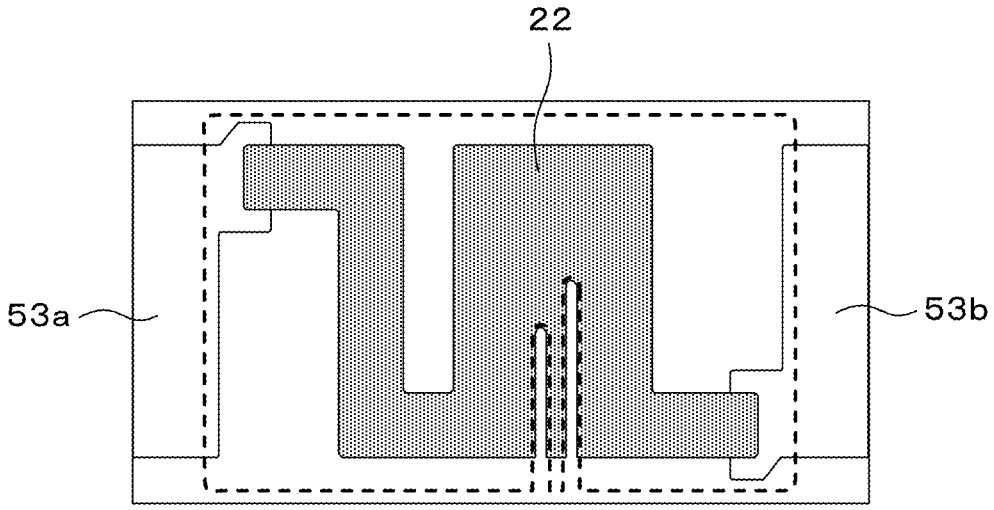
FIG. 11 is a diagram illustrating a modified example of the shape of the resistive elements.
Figure 12A:
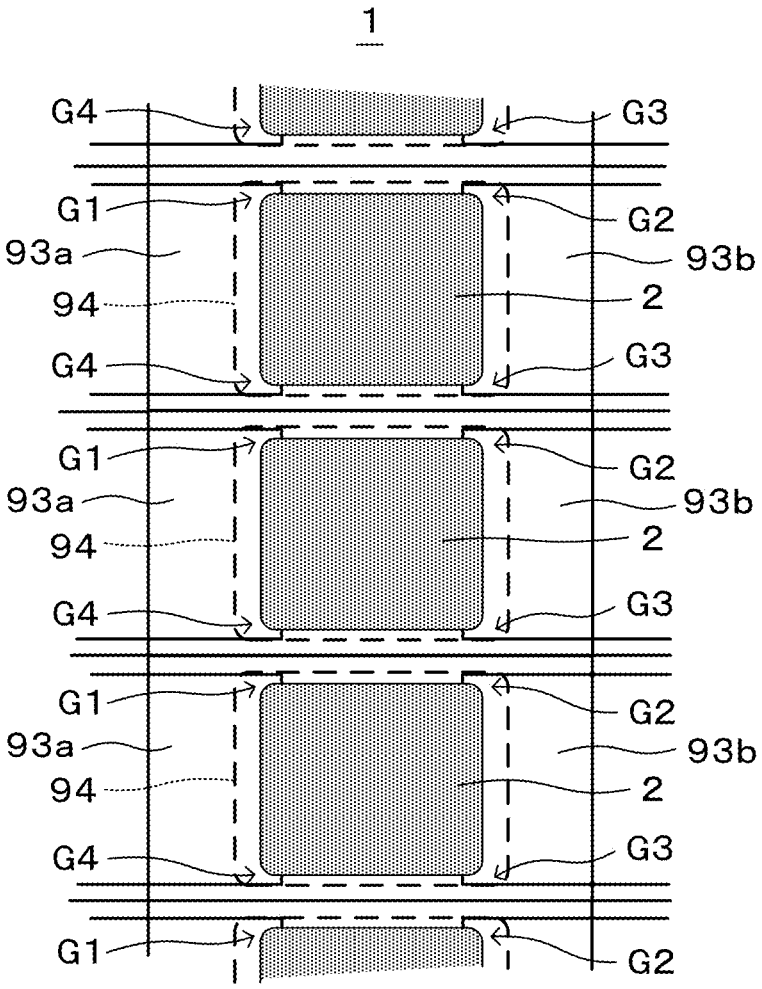
FIGS. 12A and 12B illustrate problems of a conventional technology.
Figure 12B:
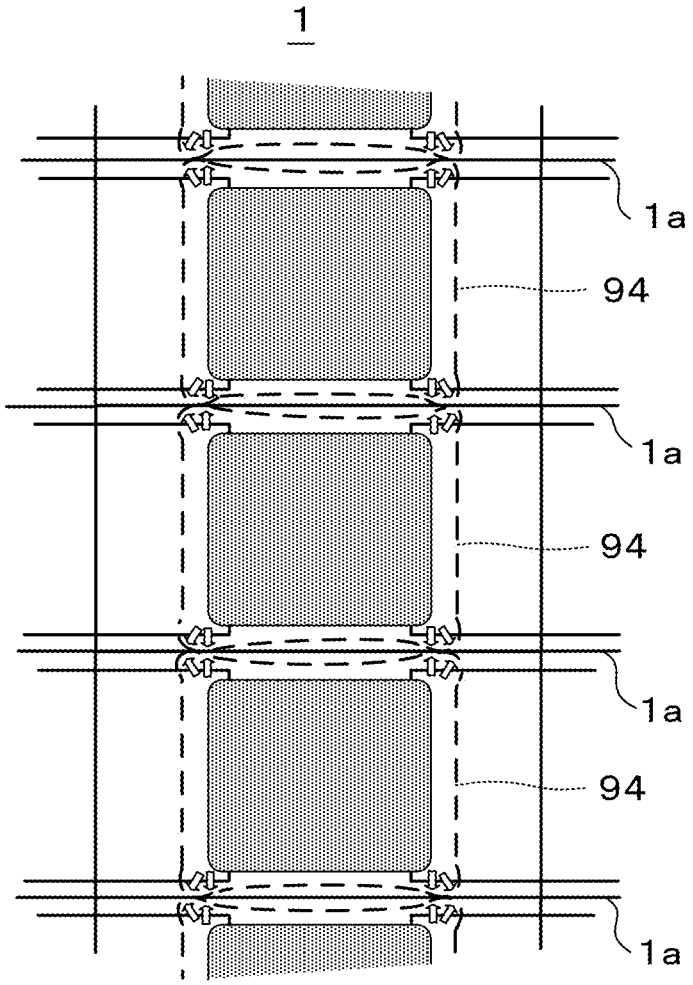

On the other hand, the form of the resistive elements is also not limited to those of the examples illustrated in FIG. 1 etc. For example, as illustrated in FIG. 11, a resistive element 22 may have a meandering pattern. As a result, the electrodes may be formed at positions closer to the dividing grooves (primary dividing grooves described above) so as to guide the resistive element 22 between the electrodes for a long distance. This is an advantageous structure for the chip resistor particularly in a moderate-resistance range and a high-resistance range.

The chip resistor according to the embodiment described above may resolve a particular problem that does not occur with a resin protective film made of resin paste, but occurs when after dividing grooves are formed, glass paste is extruded individually into regions divided by the dividing grooves, thereby forming glass protective films.

That is, by using a structure in which the glass protective films are formed such that the boundaries of the electrodes do not exist at the base of the corner portions of the rectangular glass protective films (such that the side portions of the electrodes do not overlap the corner parts of the protective films) so as to eliminate level differences generated due to thicknesses of the electrodes, a problem that the corner portions of the glass protective films bleed to the outside of the substrate in the step of printing the glass paste individually on chip elements of the chip resistor in the large substrate from which multiple chips will be obtained may be resolved.

Moreover, of the top surface electrodes formed on the large substrate from which multiple chips will be obtained, the connecting portions with the resistive elements are made to have a form including wider extension parts than the resistive elements, the resistive elements and the extension parts are covered by the glass protective films, and then trimming for adjusting resistance values is carried out. As a result, current to be measured used for trimming may be prevented from leaking to adjacent electrodes, making highly precise resistance measurement possible, and thereby narrowing difference in resistance value allowance.

In addition, use of the structure described above contributes to reduce the areas of the electrodes from becoming larger, thereby gaining a merit in terms of cost, even when reducing the areas of the resistive elements in a small chip resistor that has standardized outer dimensions so as to lower the resistance.

DESCRIPTION OF REFERENCES

1: Insulation substrate
2, 22, 37: Resistive element
3*a*, 3*b*, 23*a*, 23*b*, 35, 53*a*, 53*b*: Top surface electrode
4, 39: Glass protective film
8, 43: Slit for resistance value adjustment (trimming groove)
10: Chip resistor
31: Primary dividing groove
33: Back electrode
41: Secondary dividing groove
45: Resin protective film
A1, A2, B1, B2: Extension part
C1-C4: Corner portions of glass protective film (four corner portions)

The invention claimed is:

1. A chip resistor comprising:
a rectangular parallelepiped insulation substrate;
paired top surface electrodes arranged facing each other at predetermined intervals at either longitudinal end part on the top surface of the insulation substrate;
a resistive element formed between the paired top surface electrodes; and
a rectangular protective film covering a predetermined region of the insulation substrate; wherein
the predetermined region is a region including the entire top surface of the resistive element and connection regions of the resistive element and the paired top surface electrodes, and the protective film is formed so as for four corner portions of the protective film in plan view to not overlap the paired top surface electrodes, and so as to avoid either longitudinal end part on the top surface of the insulation substrate, wherein
the paired top surface electrodes each comprise an extension part having a wider width than that of the resistive element in the lateral direction of the insulation substrate at the connection regions, and other regions excluding the extension parts have substantially the same width as that of the resistive element.

2. The chip resistor according to claim 1, wherein the width of the extension parts gradually changes so as to approach the width of the resistive element the further toward either longitudinal end part of the insulation substrate.

3. The chip resistor according to claim 1, wherein the protective film is a glass protective film.

4. A chip resistor manufacturing method, comprising the steps of:

forming latticed primary dividing grooves and secondary dividing grooves orthogonal to each other on the top surface of a large insulation substrate from which multiple chip resistors are obtained;

forming multiple electrodes facing each other at predetermined intervals in multiple predetermined regions divided by the primary and the secondary dividing grooves on the top surface of the large insulation substrate;

forming multiple resistive elements respectively stretching over the multiple electrodes arranged facing each other;

forming a rectangular glass protective film for individually covering regions including the entire top surfaces of the respective multiple resistive elements and connection regions of the multiple resistive elements with the respective multiple electrodes;

forming a trimming groove in the respective multiple resistive elements after the glass protective film is formed, so as to adjust resistance values;

dividing the large insulation substrate along the primary dividing grooves so as to obtain strip substrates;

forming end electrodes on side surfaces of the strip substrates; and dividing the strip substrates, on which the end electrodes are formed, along the secondary dividing grooves so as to obtain chip resistive elements; wherein the glass protective film is formed so as for four corner portions of the glass protective film in plan view to not overlap the respective multiple electrodes, and so as to avoid the secondary dividing grooves, wherein the multiple electrodes each comprise an extension part having a wider width than that of each of the multiple resistive elements in the direction of the primary dividing grooves at each of the connection regions, and other regions excluding the extension parts have substantially the same width as that of each of the multiple resistive elements.

5. The chip resistor manufacturing method according to claim 4, further comprising the step of forming multiple resin protective films extending in a belt-like form along the primary dividing grooves.

* * * * *